US008000621B2

(12) United States Patent
Inukai

(10) Patent No.: US 8,000,621 B2
(45) Date of Patent: Aug. 16, 2011

(54) IMAGE FORMING APPARATUS

(75) Inventor: Katsumi Inukai, Iwakura (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 481 days.

(21) Appl. No.: 12/189,836

(22) Filed: Aug. 12, 2008

(65) Prior Publication Data

US 2009/0052923 A1 Feb. 26, 2009

(30) Foreign Application Priority Data

Aug. 22, 2007 (JP) ..... 2007-216298

(51) Int. Cl.
*G03G 15/16* (2006.01)

(52) U.S. Cl. ..... 399/66

(58) Field of Classification Search ..... 399/66, 399/279, 310

See application file for complete search history.

(56) References Cited

U.S. PATENT DOCUMENTS

| | | | | |
|---|---|---|---|---|
| 6,900,994 | B2 | 5/2005 | Asayama | |
| 2004/0165902 | A1* | 8/2004 | Matsuura | 399/66 |
| 2007/0008746 | A1 | 1/2007 | Inukai et al. | |
| 2007/0014129 | A1 | 1/2007 | Inukai | |

FOREIGN PATENT DOCUMENTS

| | | |
|---|---|---|
| JP | 07-093039 | 4/1995 |
| JP | 2004037635 | 2/2004 |
| JP | 2007020367 | 1/2007 |
| JP | 2007049889 | 2/2007 |

OTHER PUBLICATIONS

Notice of Reasons for Refusal for Japanese Patent Application No. 2007-216298 mailed Sep. 1, 2009.

* cited by examiner

*Primary Examiner* — David M Gray
*Assistant Examiner* — Barnabas T Fekete
(74) *Attorney, Agent, or Firm* — Banner & Witcoff Ltd.

(57) ABSTRACT

An image forming apparatus is configured to reduce follow-up delay in impedance fluctuation and to reduce an accuracy fall in power supply control. The image forming apparatus includes a transfer element, a supply element, a detection element, a modification element, and a switch element. The supply element supplies electricity that depends on a set value to the transfer element. The detection element detects the control object value supplied to the transfer element. Depending on a difference between the control object value detected by the detection element and a target value, the modification element operates modification of the set value. The switch element switches between a short interval mode and a long interval mode. In a short interval mode, an execution time interval for modification of the set value is shorter, while, in a long interval mode, the execution time interval for modification of the set value is longer.

20 Claims, 5 Drawing Sheets

IMAGE FORMING APPARATUS

CROSS REFERENCE TO RELATED APPLICATION

This application claims priority from Japanese Patent Application No. 2007-216298 filed on Aug. 22, 2007. The entire content of this priority application is incorporated herein by reference.

TECHNICAL FIELD

The present invention relates to an image forming apparatus.

BACKGROUND

An image forming apparatus has an electric load such as a transfer roller, and a power supply device that controls power supply to the electric load. A known power supply device includes a PWM circuit that outputs a PWM (pulse width modulation) signal and a high voltage generation device that supplies voltage that depends on a pulse width of the PWM signal to the electric load. The PWM circuit detects an instantaneous voltage value supplied to the electric load, compares the detected value with a target value, and, depending on the difference between the detected value and the target value, modifies the pulse width of the PWM signal. The instantaneous voltage value is thus forced to reach to the target value.

In the image forming apparatus, when, for example, a sheet enters between a transfer roller and a photoconductor, impedance between the transfer roller and the photoconductor drastically varies, which causes wide variation in the instantaneous voltage value (a transfer voltage value). The known power supply device, however, is configured to always wait for a constant time after modification of the pulse width of the PWM signal, and only after then, modify the next pulse width. Therefore, when impedance widely fluctuates as above, the known power supply device has a problem of follow-up delay in output from the high voltage generation device against the modification of the pulse width. A considered means for solving this problem is to shorten an execution time interval for modification of the pulse width (the above constant time), however, a shortened execution time interval may be affected by the follow-up delay and cause instability in the instantaneous transfer voltage value, which results in lower accuracy in power supply control. For example, if the transfer voltage is instable when transferring developer images on the photoconductor to the recording medium, transfer trouble and the like can occur, therefore resulting in lower transfer quality.

SUMMARY

One aspect of the present invention is an image forming apparatus, including a transfer element, a supply element configured to supply electricity to the transfer element, the electricity depending on a set value, a detection element configured to detect a control object value, the control object value including either one of a voltage value and a current value, the control object value being supplied to the transfer element, a modification element configured to operate a modification of the set value, the modification depending on a difference between the control object value detected by the detection element and a target value, and a switch element configured to switch between a short interval mode and a long interval mode. An execution time interval for the modification of the set value by the modification element is shorter in the short interval mode, and the execution time interval for the modification of the set value is longer in the long interval mode.

With this aspect of the present invention, the image forming apparatus is configured to be capable of switch between the short interval mode wherein the execution time interval for modification of the set value by the modification element is shorter and the long interval mode wherein the execution time interval for modification of the set value is longer. Therefore, the follow-up delay against the impedance fluctuation and the accuracy fall in power supply control can be reduced by properly switching these modes.

DETAILED DESCRIPTION OF THE PREFERRED ILLUSTRATIVE ASPECTS

One illustrative aspect of the present invention will be described with reference to FIGS. 1 through 5.

(Outline Configuration of a Laser Printer)

Figure 1:
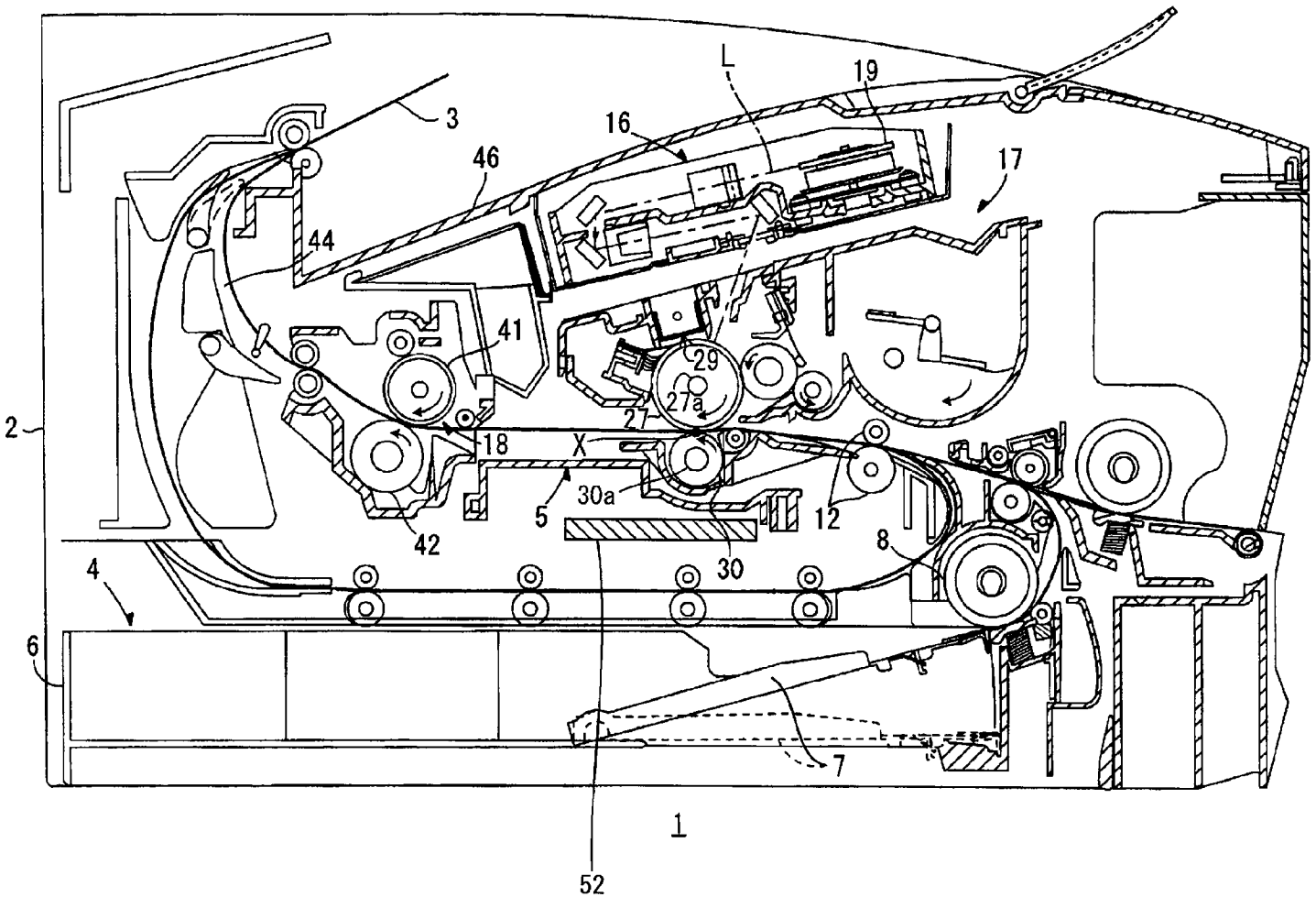
FIG. 1 is a sectional side view of a portion of a printer in accordance with one illustrative aspect of the present invention.

FIG. 1 is a sectional side view of a portion of a laser printer (hereinafter referred as a printer 1, which corresponds to an image forming apparatus). Note that, hereinafter, the printer 1 will be described as having a left and right side in FIG. 1 that corresponds to a rear and front side of the printer 1, respectively. In FIG. 1, the printer 1 includes a body frame 2. The body frame 2 includes a feeder portion 4 for feeding sheets 3 (one example of a recording medium, which can include, without limitation, paper, plastic, or the like), an image forming portion 5 for forming images on the sheets 3 fed thereon, and the like.

(1) Feeder Portion

The feeder portion 4 includes a feed tray 6, a platen 7, a feed roller 8, and a registration roller 12. The platen 7 is pivotable about the rear end portion thereof, and an uppermost sheet 3 on the platen 7 is pressed against the feed roller 8. The sheets 3 on the platen 7 are fed one by one by rotation of the feed roller 8.

Each of the fed sheet 3 is registered by the registration roller 12 and then is conveyed to a transfer position X. Note that the transfer position X is a position where a toner image on a photosensitive drum 27 is transferred to the sheet 3. The transfer position X is a contacting position of the photosensitive drum 27 (one example of a photoconductor) with a transfer roller 30 (one example of a transfer element).

(2) Image Forming Portion

The image forming portion 5 includes a scanner portion 16, a process cartridge 17, and a fixation portion 18.

The scanner portion 16 includes a laser emitter (not illustrated), a polygon mirror 19, and the like. Laser light L emitted from the laser emitter is deflected by the polygon mirror 19 and applied to a surface of the photosensitive drum 27.

The process cartridge 17 includes a developing roller 31 (one example of an developing element), the photosensitive drum 27, an charger 29 (i.e. of scorotron type), and the transfer roller 30. Note that the photosensitive drum 27 is grounded at a drum shaft 27 thereof to the ground.

The charger 29 uniformly and positively charges the surface of the photosensitive drum 27. After then, the surface of the photosensitive drum 27 is irradiated with the laser light L from the scanner portion 16, and thus an electrostatic latent image is formed on the photosensitive drum 27. Next, toner carried on a surface of the developing roller 31 is supplied to the electrostatic latent image. The electrostatic latent image is thus developed.

The transfer roller 30 has a metal roller shaft 30*a*. Connected to the roller shaft 30*a* is an applying circuit 60 (see FIG. 2) that is connected to a high-voltage power supply circuit substrate 52. During transfer operation, transfer voltage Va is applied from the applying circuit 60 to the roller shaft 30*a*.

The fixation portion 18 heat-fixes the toner on the sheet 3 while the sheet 3 passes between a heat roller 41 and a press roller 42. The heat-fixed sheet 3 is then moved through an ejection path 44 onto an ejected tray 46.

(Configuration of Applying Circuit)

Figure 2:
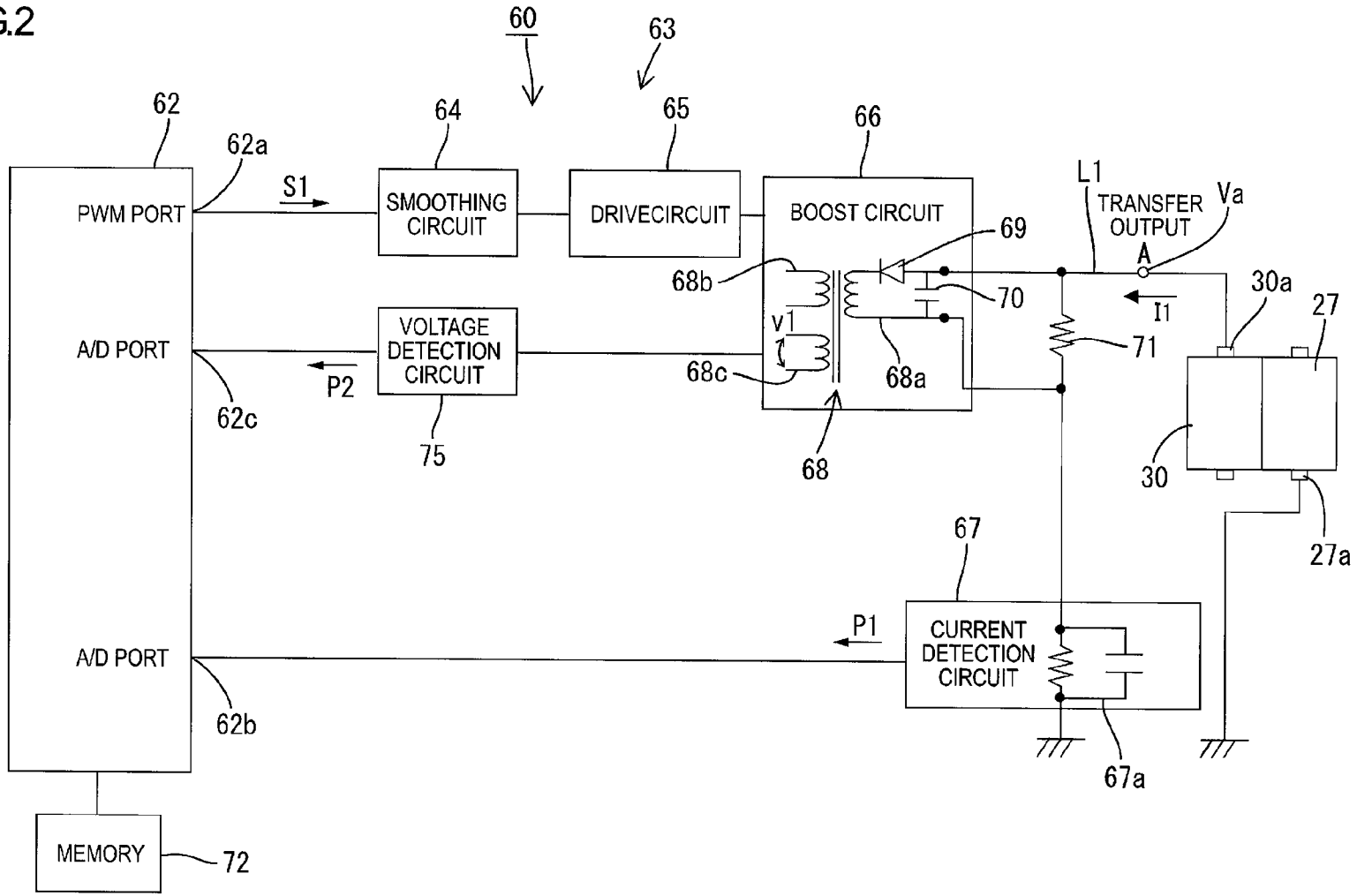
FIG. 2 is a block diagram of a configuration of a portion of an applying circuit.

FIG. 2 shows a block diagram of a configuration of a portion of the applying circuit 60. The applying circuit 60 is configured to apply the transfer voltage Va to the transfer roller 30. The applying circuit 60 includes a control circuit 62 and a high voltage output circuit 63 (one example of a supply element).

The high voltage output circuit 63 includes a smoothing circuit 64, a drive circuit 65, a boost circuit 66, and a current detection circuit 67.

The smoothing circuit 64 receives a PWM (pulse width modulation) signal S1 from a PWM port 62*a* of the control circuit 62, and smoothes the PWM signal S1. The smoothing circuit 64 then gives the PWM signal S1 to the drive circuit 65. The drive circuit 65 is configured so as to receive the PWM signal S1 and, based on the PWM signal S1, apply oscillation current to a first winding 68*b* of the boost circuit 66.

The boost circuit 66 includes a transformer 68, a diode 69, a smoothing capacitor 70, and the like. The transformer 68 includes a second winding 68*a*, the first winding 68*b*, and an auxiliary winding 68*c*. One of the ends of the second winding 68*a* is connected via the diode 69 and a connecting line L1 to the roller shaft 30*a* of the transfer roller 30. The other end of the second winding 68*a* is grounded via the current detection circuit 67. In addition, each of the smoothing capacitor 70 and a discharge resistance 71 is connected in parallel to the second winding 68*a* and the diode 69.

With the above configuration, oscillation current in the first winding 68*b* is boosted and rectified in the boost circuit 66, and applied as the transfer voltage Va to the roller shaft 30*a* of the transfer roller 30. At this point, transfer current I1 that flows through the transfer roller 30 (taking a value of current that flows in the direction of an arrow in FIG. 2) flows into a RC parallel circuit 67*a*, and a detection signal P1 that depends on the transfer current I1 is fed back to an A/D port 62*b* of the control circuit 62.

Then, at a time of the transfer operation when the sheet 3 reaches the transfer position X and the toner image on the photosensitive drum 27 is transferred onto the sheet 3, the control circuit 62 sends the PWM signal S1 to the high voltage output circuit 63 (the smoothing circuit 64). The transfer voltage Va is thus applied to the roller shaft 30*a* of the transfer roller 30 that is connected to an output end A of the high voltage output circuit 63. At the same time, the control circuit 62 executes constant current control based on the detection signal P1 that depends on the current value of the transfer current I1 flowing through the connecting line L1. In the constant current control, the PWM signal (hereinafter referred as a PWM value) S1, which duty ratio (one example of a set value) is properly modified, is output to the smoothing circuit 64. The current value of the transfer current I1 is set to be within a target range (where the feedback value of the transfer current I1 is within a target feedback range between an upper limit value Vth1 and a lower limit value Vth2). Accordingly, in this embodiment, the current value of the transfer current I1 corresponds to a control object value, while the control circuit 62 and the current detection circuit perform as a detection element. Furthermore, the control circuit 62 performs also as a modification element.

(Configuration for Measuring Impedance)

Next, a configuration for measuring variation in impedance in a power supply path that supplies electricity to the transfer roller 30 will now be described. Note that the power supply path is a path from the output end A through the transfer roller 30 and the photosensitive drum 27 to the ground.

As shown in FIG. 2, the applying circuit 60 includes the voltage detection circuit 75. The voltage detection circuit 75 is connected between the auxiliary winding 68*c* of the transformer 68 of the boost circuit 66 and the control circuit 62. At the time of the transfer operation by the applying circuit 60, the voltage detection circuit 75 detects output voltage v1 generated between the auxiliary winding 68*c* and outputs a detection signal P2 based on the output voltage v1 to the A/D port 62*c*.

The control circuit 62 imports the above detection signals P1, P2 and calculates the instantaneous impedance of the transfer roller 30 from the current value of the transfer current I1 and the voltage value of the output voltage v1. Specifically, the transfer voltage Va can be estimated from the voltage value of the output voltage v1 and a relation between the numbers of turns of the second winding 68*a*, the first winding 68*b*, and the auxiliary winding 68*c*. Then, the estimated transfer voltage Va is divided by the current value of the transfer current I1 to obtain the impedance. At this point, the control circuit 62, the current detection circuit 67, and the voltage detection circuit 75 perform as a measurement element.

(Control by Control Circuit)

Figure 3:
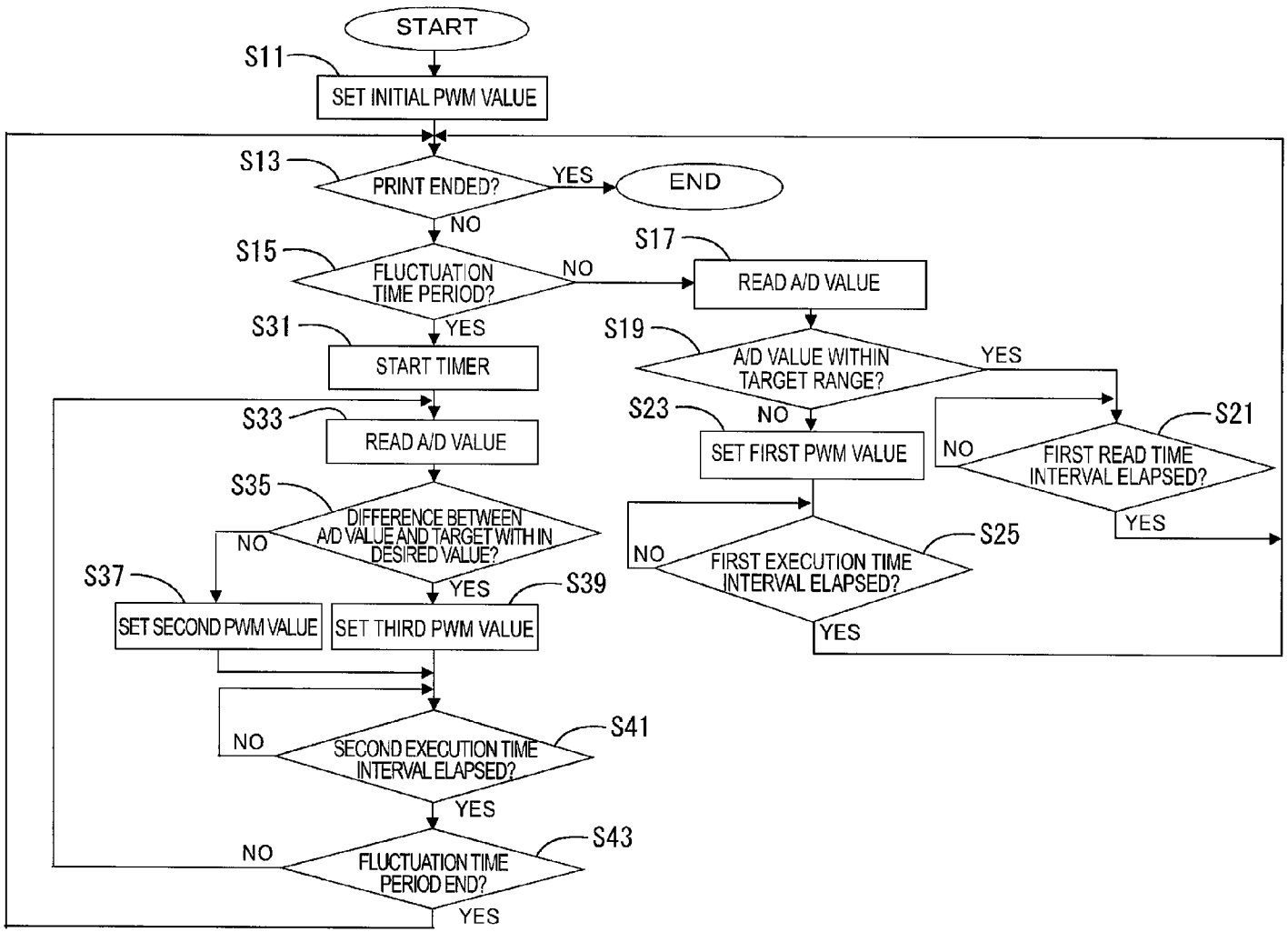
FIG. 3 is a flowchart of main processing of current control.

When the printer 1 is requested print processing by, for example, receiving print data from an external information technology equipment (e.g. a personal computer), the control circuit 62 executes current control shown in FIG. 3. Note that this embodiment is arranged such that when the PWM value (the duty ratio) is enlarged, the current value of the transfer current I1 increases.

First, in S11, the control circuit 62 sets, for example, an initial PWM value D0 (a smaller value than a PWM value that sets the current value of the transfer current I1 to reach the above target range). After then, the control circuit 62 waits until time t0 (e.g. 10 ms) elapses. Time T0 is a time from when the initial PWM value D0 is set to when an A/D value of the detection signal P1 (hereinafter referred as a feedback value of the transfer current I1) is stabilized to some extent (e.g. 0 to 2.5V).

Next, in S13, the control circuit 62 determines whether the above print processing has entirely ended and, when the print processing has not ended (S13: NO), the control circuit 62 determines in S15 whether it is a fluctuation time period. Note here that the "fluctuation time period" is a time period when the current value of the transfer current I1, that is a control object value, drastically fluctuates. In this embodiment, a time period when a lead edge of the sheet 3 fed from the feed tray 6 enters the transfer position X (hereinafter referred as an "entering time period") and a time period when a rear edge of the sheet 3 leaves the transfer position X (hereinafter referred as a "leaving time period") is taken as the fluctuation time period. Note that the control circuit 62 can determine whether it is the entering time period or it is the leaving time period based on a count time from a time point when, for example, the sheet 3 is released by the registration roller 12. In a case where a sensor for detecting the sheet 3 is provided in a conveying path (in the upstream of the transfer position X), it may be arranged such that the control circuit 62 determines whether it is the entering time period or it is the leaving time period based on a count time from a time point when the sheet 3 is detected by the sensor.

When it is not the fluctuation time period (S15: NO), the control circuit 62 executes a long interval mode (S17 to S25). Otherwise, when it is the fluctuation time period (S15: YES), the control circuit 62 executes a short interval mode (S31 to S43). While in both the long interval mode and the short interval mode, in a case where the feedback value of the transfer current I1 is out of the target feedback range, modifying operation is operated to modify the PWM value of the PWM signal S1 depending on the difference between the feedback value and the target feedback range, an execution time interval for the modification processing in the short interval mode is shorter than that in the long interval mode. Note that the control circuit 62 performs as a modification element at this point.

(1) Long Interval Mode

For example, until when the lead edge of the sheet 3 (fed from the feed tray 6) reaches a start point of the transfer position X, it is not the fluctuation time period. Accordingly, the control circuit 62 executes the long interval mode then.

Specifically, the control circuit 62 first reads the feedback value of the transfer current I1 (the A/D value of the detection signal P1) in S17. Then, when the feedback value of the transfer current I1 is within the target feedback range (S19: YES), the control circuit 62 waits until a first read time interval (e.g. 15 ms) elapses (S21: YES), and then returns to S13. Namely, in a case where it is not the fluctuation time period and where the transfer current I1 is within the target range, the control circuit 62 repeats the operation to read the feedback value of the transfer current I1 in every first read time interval.

On the other hand, when the feedback value of the transfer current I1 is out of the target feedback range (S19: NO), the control circuit 62 calculates a first PWM value D1 in S23. The first PWM value D1 is calculated by the following formula 1:

$$D1=Dc+(Ft-Fi)*\{G1*(Dc/Fi)\} \quad \text{(Formula 1)}$$

where "Dc" is the instantaneous PWM value; "G1" is a first coefficient (e.g. G1=1); "Fi" is the feedback value of the instantaneous transfer current I1; and "Ft" is a feedback value of the transfer current I1 when the current value of the transfer current I1 is within the above target range (a value in the target feedback range, e.g. the lower limit value Vth2 or the center value).

Figure 4:
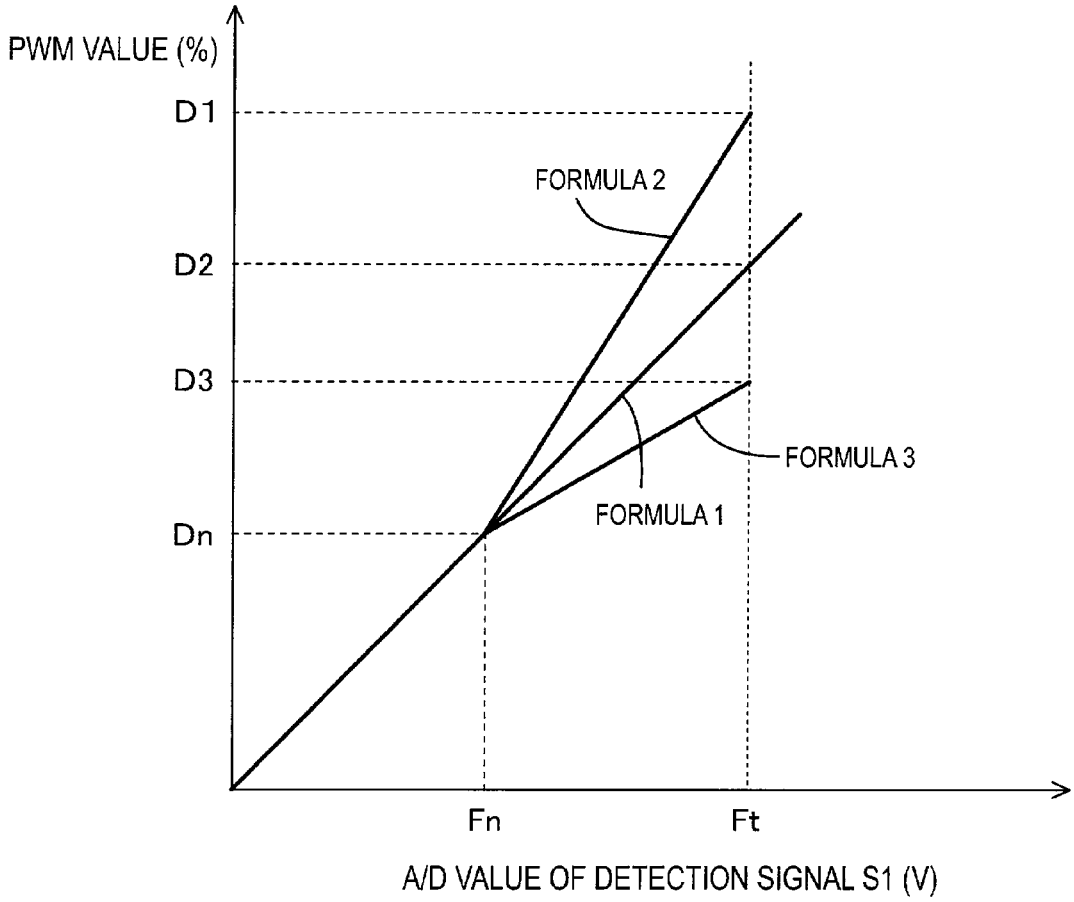
FIG. 4 is a graph showing a relation between A/D values of a detection signal and PWM values in formulas.

The first PWM value D1 is a duty ratio that is necessary to force the feedback value Fi of the instantaneous transfer current I1 to reach the target feedback value Ft (see FIG. 4). In the above formula 1, "(Ft−Fi)*{G1*(Dc/Fi)}" is ΔD1(=D1−Dc), that is a modification amount of the PWM value that depends on the difference between the feedback value Fi and the target feedback value Ft; and "G1*(Dc/Fi)" is the modification amount of the PWM value per a unit amount of the difference between the feedback value Fi and the target feedback value Ft (hereinafter referred as an "modification unit amount").

Note here that, in this embodiment, the first coefficient G1 is set to a value that meets conditions to stabilize the feedback value Fi of the instantaneous transfer current I1 equal or close to the target feedback value Ft within a first execution time interval, which will be described below. However, the value for the first coefficient G1 that meets the conditions differs by the impedance in the above power supply path. Therefore, combinations of values for the first coefficient G1 and values of the impedance that meet such conditions are obtained in advance by experiments, and based on the combinations, a table of correspondence relation between the values for the first coefficient G1 (alternatively, they may be values for G1*(Dc/Fi)) and the values of the impedance is prepared. Then, this table is stored in a memory 72 (one example of a memory element). In the table, the correspondence relation is arranged such that a larger value of the impedance corresponds to a larger value for the first coefficient G1. The control circuit 62 calculates the value of the instantaneous impedance based on the above detection signals P1, P2, extracts a proper value for the first coefficient G1 corresponding to this impedance from the correspondence relation table, and substitute the extracted value for the first coefficient G1 in the formula 1. The control circuit 62 performs as a correction element at this point.

Then, the control circuit 62 set the first PWM value D1 calculated by using the above formula 1 as the PWM value of the PWM signal S1, waits for the first execution time interval in S25, and returns to S13. The "first execution time interval" is set to a longer time (e.g. 30 to 40 ms) than a stabilizing time. The stabilizing time is a time from when the control circuit 62 sets the first PWM value D1 (in other words, from when the control circuit 62 modifies the PWM value of the PWM signal S1) to when a fluctuation width of the feedback value Fi of the transfer current I1 comes into a desired range (e.g. 0.05 V), i.e. into a stable period (a stationary state). The point is that, in the long interval mode, in the case where the transfer current I1 is out of the target range, the control circuit 62 waits until when the fluctuation width of the feedback value Fi comes into the stable period after the PWM value of the PWM signal S1 is modified.

(2) Short Interval Mode

When, for example, the lead edge of the sheet 3 fed from the feed tray 6 has reached the start point of the transfer position X and has entered the entering time period, the impedance between the photosensitive drum 27 and the transfer roller 30 drastically increases, which causes the transfer current I1 to drastically decrease and widely fluctuate (S15: YES). Accordingly, the control circuit 62 switches from the long interval mode to the short interval mode. The control circuit 62 performs as the switch element at this point.

First, the control circuit 62 resets an internal timer to zero and starts a time count in S31, and then reads the feedback value Fi of the transfer current I1 (the A/D value of the detection signal P1) in S33. Next, the control circuit 62 determines in S35 whether the difference between the feedback value Fi and the above target feedback range is equal to or less than the desired value.

When the difference between the feedback value Fi and the target feedback range is more than the desired value (S35: NO), the control circuit 62 calculates a second PWM value D2 in S37. The second PWM value D2 is calculated by the following formula 2:

$$D2=D1+(Ft-Fi)*\{G2*(Dc/Fi)\} \quad \text{(Formula 2)}$$

where "G2" is a second coefficient (>G1, e.g. G2=2).

In the above formula 2, "(Ft−Fi)*{G2*(Dc/Fi)}" is a modification amount of the PWM value ΔD2 (=D2−D1) that depends on the difference between the feedback value Fi and the target feedback value Ft. "G2*(Dc/Fi)" is the modification unit amount in the formula 2 and is larger than the modification unit amount for the above long interval mode (see formula 1). "D1" is a first PWM value that is calculated using the above formula 1. The control circuit 62 calculates the first PWM value D1 using the feedback value Fi of the formula 1, and adds the above modification amount ΔD2 to the obtained first PWM value D1 (a base set value) and thereby calculates the second PWM value (see FIG. 4).

Note here that a variation amount of the feedback value Fi for the above modification unit amount differs by the impedance in the above power supply path. Therefore, it is preferable to modify the second coefficient G2 depending on the impedance so that the variation amount of the feedback value Fi be a fixed value. Therefore, combinations of values for the second coefficient G2 and the values of the impedance that meet such conditions are obtained in advance by experiments, and based on the combinations, a table of correspondence relation between the values for the second coefficient G2 (alternatively, they may be values for G2*(Dc/Fi)) and the values of the impedance is prepared. Then, this table is stored in a memory 72. In the table, the correspondence relation is arranged such that a larger value of the impedance corresponds to a larger value for the second coefficient G2. The control circuit 62 calculates the value of the instantaneous impedance based on the above detection signals P1, P2, extracts a proper value for the second coefficient G2 corresponding to the calculated value of the impedance from the table, and substitutes the extracted value for the second coefficient G2 in the formula 2.

Then, the control circuit 62 set the second PWM value D2 (calculated by using the above formula 2 as the PWM value of the PWM signal S1), waits for the second execution time interval in S41, and then goes to S43. The "second execution time interval" is set to a shorter time (e.g. 5 ms) than a time from when the control circuit 62 sets the first PWM value D1 (in other words, from when the control circuit 62 modifies the PWM value of the PWM signal S1) to when the feedback value Fi of the transfer current I1 comes into the above stable period. The point is that, in the short interval mode, in the case where the transfer current I1 is out of the target range, the control circuit 62, after modifying the PWM value of the PWM signal S1, operates further modification of the PWM value without waiting for a fluctuation width of the feedback value Fi to come into the stable period.

On the other hand, when the difference between the feedback value Fi and the target feedback range is equal to or less than the desired value (S35: YES), the control circuit 62 calculates a third PWM value D3 in S39. The third PWM value D3 is calculated by the following formula 3:

$$D3=Dc+(Ft-Fi)*\{G3*(Dc/Fi)\} \quad \text{(Formula 3)}$$

where "G3" is a third coefficient (<G1, e.g. G3=0.5).

In the above formula 3, "(Ft−Fi)*{G3*(Dc/Fi)}" is a modification amount of the PWM value ΔD3 (=D3−Dc) that depends on the difference between the feedback value Fi and the target feedback value Ft. "G3*(Dc/Fi)" is the modification unit amount in the formula 3 and is smaller than the modification unit amount for the above long interval mode (see the formula 1). While the above second PWM value D2 is calculated by the formula 2 with using the first PWM value D1 calculated by the above formula 1 for the long interval mode, the third PWM value D3 is calculated only by the formula 3 without using the first PWM value.

Note here that the control circuit 62 obtains a value for the third coefficient G3 in a manner similar to obtaining the value for the second coefficient G2. Namely, the control circuit 62 extracts a proper value for the third coefficient G3 based on a table of correspondence relation between values for the third coefficient G3 (alternatively, they may be values for G3*(Dc/Fi)) and values of the impedance. Thus, a variation amount of the feedback value Fi for the above modification unit amount is a fixed value independent of the variation in impedance in the above power supply path. After that, the control circuit 62 substitutes the extracted value for the third coefficient G3 in the formula 3.

Then, the control circuit 62 sets a third PWM value D3 calculated by using the above formula 3 as the PWM value of the PWM signal S1, waits for the second execution time interval in S41, and then goes to S43. The control circuit 62 repeats the processing from S33 to S41 during the fluctuation time period (S43: NO). When the lead edge of the sheet 3 has passed through the transfer position X and the fluctuation time period ends (S43: YES), and the sheet 3 comes to pass through the transfer position X, the control circuit 62 again switches to the long interval mode.

Note that when the control circuit 62 determines in S13 that the above print processing for the print data entirely ends (S13: YES), the control circuit 62 terminates the output of the PWM signal S1 and ends the process shown in FIG. 3.

(Effects of This Illustrative Aspect)

Figure 5:
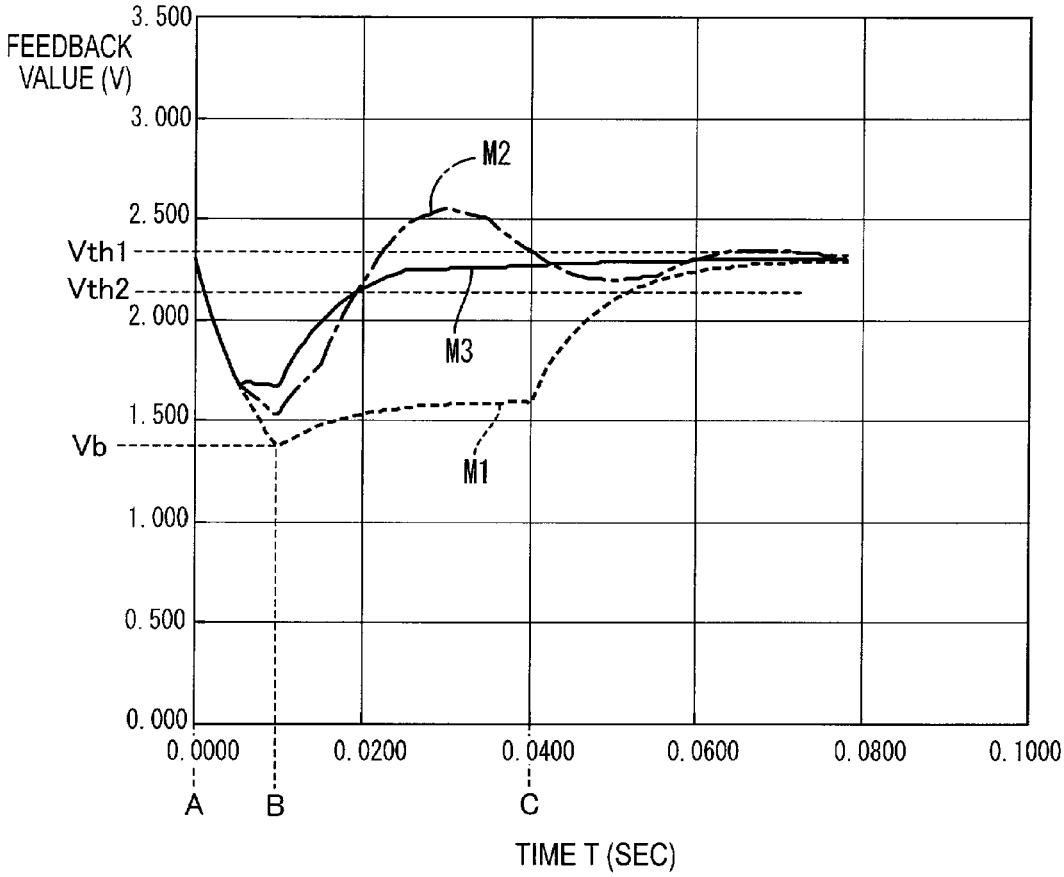
FIG. 5 is a graph showing variations in transfer current in each mode.

When the sheet 3 enters the transfer position X, and the impedance between the photosensitive drum 27 and the transfer roller 30 drastically increases, this causes, as shown in FIG. 5, the transfer current I1 to drastically decrease. Thus, the fluctuation time period starts (S15 in FIG. 3: YES).

(1) Note here that, supposing that the long interval mode is operated also in the fluctuation time period, there is a problem that it is impossible to promptly force the transfer current I1 to reach the target range. Specifically, as shown by a dashed line M1 in FIG. 5, the feedback value Fi of the transfer current I1 decreases from a time point A where the sheet 3 enters the transfer position X. Suppose here that the control circuit 62 detects a feedback value Fi at a time point B where the feedback value Fi still is decreasing (after the feedback value Fi is decreased by the above increase of the impedance and before the feedback value Fi is stabilized at a desired level) and modifies the PWM signal S1 to a PWM value that compensate the difference between the feedback value Fi and the target feedback value Ft. However, since the feedback value Fi is still decreasing by being affected by the above increase of the impedance as above described at the time point B, the modification of the PWM signal at the time point B is insufficient for the transfer current I1 to be forced to reach the target range by (see a time point C in FIG. 5). Then, only after repeats of the insufficient control that cannot force the transfer current I1 to reach the target range, the transfer current I1 finally reaches the target range. Although the transfer current I1 eventually reaches the target range, the problem is that it is not done promptly.

To the contrary, in this illustrative aspect, as described above, the short interval mode is operated during the fluctuation time period. In this short interval mode, in the case where the transfer current I1 is out of the target range, the control circuit 62, after modifying the PWM value of the PWM signal S1, further modifies the PWM value without waiting for the fluctuation width of the feedback value Fi to come into the stable period. Therefore, as shown by a dashed-dotted line M2 and a solid line M3 in FIG. 5, rapid reaction to the fluctuation of the feedback value Fi can be realized so that the feedback value Fi is promptly forced to reach the target feedback value Ft side (in other words, the transfer current I1 to the target range side) as compared to the dashed-dotted line M2 and the solid line M3 each with the dashed line M1.

After then, when the fluctuation time period is over and while the sheet 3 is passing through the transfer position X, transfer operation to transfer a developer image onto the sheet 3 is executed, and therefore it is specifically required to stabilize the transfer current I1 within the target range. Therefore, in this illustrative aspect, the control circuit 62 executes the long interval mode during this term. The constant current control with high accuracy can be thus realized. Note that the above effects are similar also during the above leaving time period and after the leaving time period.

(2) On the other hand, supposing that the modification unit amount in the short interval mode is always set to the constant value similarly to the modification unit amount in the long interval mode (the first coefficient G1=1), it is a concern that, as shown by the dashed-dotted line M2 in FIG. 5, the feedback value Fi can overshoot the target feedback value Ft. To the contrary, in this illustrative aspect, the modification unit amount of the PWM value is modified according to whether the difference between the feedback value Fi and the target feedback range is more than the desired value. Specifically, at the beginning of the fluctuation time period, when the transfer current I1 widely decreases and the difference between the feedback value Fi and the target feedback range is more than the desired value, constant current control is operated with the modification unit amount that is larger than that of the long interval mode (G2>G1). Subsequently, when the transfer current I1 comes closer to the target range and the difference between the feedback value Fi and the target feedback range is equal or less than the desired value, constant current control is operated with the modification unit amount that is smaller than that of the long interval mode (G3<G1). Thus, as shown by the solid line M3 in FIG. 5, the overshooting as above is reduced as compared to the solid line M3 with the dashed-dotted line M2.

(3) In this illustrative aspect, in the case where the difference between the feedback value Fi and the target feedback range is more than the desired value in the short interval mode, the control circuit 62 concurrently calculates also the first PWM value D1 of the long interval mode, and adds the modification amount ΔD2 based on the modification unit amount of the short interval mode to this first PWM value D1 (the base set value) and thereby calculates the second PWM value. Note here that, supposing a configuration wherein the modification amount ΔD2 based on the modification unit amount of the short interval mode is simply accumulated without using the above base set value, it is a concern that the feedback value Fi so widely varies that the difference between the target feedback range is difficult to is equal to or less than the desired value, and thus the follow-up performance can be lower. To the contrary, with the configuration of this illustrative aspect, the variation in the control object value in the short interval mode can be forced closer to the variation in the long interval mode where the control is stable to some extent.

Other Embodiments

The present invention is not limited to the illustrative aspect described in the above description made with reference to drawings, but the following embodiments may be included in the technical scope of the present invention, for example.

(1) "The time period when the fluctuation of the control object is wide" is, in the above illustrative aspect, the entering time period and the leaving time period. However, the time period may be only either one of the entering time period and the leaving time period. Furthermore, the time period may be neither of the entering time period and the leaving time period. For example, it may be a start period when the supply element starts to supply electricity to the transfer element (in the above illustrative aspect, when the initial PWM value D0 is set).

(2) "The set value" may be not only the duty ratio (the pulse width) of the PWM signal S1 but also be, for example, an amplitude of the PWM signal S1.

(3) As the correcting method, a configuration to use a formula of correspondence relation between a measured value by the measurement element and the modification unit amount of the set values (G1, G2, G3) is also available. However, by using the data of correspondence relation as the above illustrative aspect, a processing load for the correction is reduced.

(4) The above illustrative aspect is configured to correct the values for G1 to G3 in the formulas by using the tables of correspondence relation stored in the memory 72, and the processing load for the correction is thus reduced. However, the correction may be operated based on a formula for this correspondence relation (for example, a proportional formula of values of G to the impedance). With this configuration, it is unnecessary to store the tables, and therefore memory volume is reduced.

(5) The above illustrative aspect is described with taking constant current control as an example. However, it may be constant voltage control and, in this case, transfer voltage Va is taken as the control object value.

What is claimed is:

1. An image forming apparatus, comprising:

a transfer element;

a supply element configured to supply electricity to said transfer element, said electricity depending on a set value;

a detection element configured to detect a control object value, said control object value including either one of a voltage value and a current value, said control object value being supplied to said transfer element;

a modification element configured to operate a modification of said set value, said modification depending on a difference between said control object value detected by said detection element and a target value; and a switch element configured to switch between a short interval mode and a long interval mode, wherein:

an execution time interval for said modification of said set value by said modification element in said short interval mode is shorter than said execution time interval for said modification of said set value in said long interval mode, said switch element is configured to switch to said short interval mode in a time period when a recorded medium enters a transfer position in said transfer element, and said switch element is configured to switch to said long interval mode during a time period when said recorded medium is passing through said transfer position.

2. The image forming apparatus according to claim 1, wherein said execution time interval in said short interval mode is shorter than a stabilizing time, said stabilizing time including a time from said modification of said set value operated by said modification element to when it comes to a stable period, said stable period including a period when fluctuation of said control object value is within a predetermined range, and said execution time interval in said long interval mode is longer than said stabilizing time.

3. The image forming apparatus according to claim 1, wherein said switch element switches to said short interval mode in a time period when fluctuation of said control object value is outside of said predetermined range, and said switch element switches to said long interval mode after said time period when said fluctuation is outside of said predetermined range.

4. The image forming apparatus according to claim 2, wherein said switch element is configured to switch to said short interval mode in a time period when fluctuation of said control object value is outside of said predetermined range, and said switch element is configured to switch to said long interval mode after said time period when said fluctuation is outside of said predetermined range.

5. An image forming apparatus, comprising:

a transfer element;

a supply element configured to supply electricity to said transfer element, said electricity depending on a set value;

a detection element configured to detect a control object value, said control object value including either one of a voltage value and a current value, said control object value being supplied to said transfer element;

a modification element configured to operate a modification of said set value, said modification depending on a difference between said control object value detected by said detection element and a target value; and a switch element configured to switch between a short interval mode and a long interval mode, wherein:

an execution time interval for said modification of said set value by said modification element in said short interval mode is shorter than said execution time interval for said modification of said set value in said long interval mode, said switch element is configured to switch to said short interval mode in a time period when a recorded medium leaves said transfer position in said transfer element, and said switch element is configured to switch to said long interval mode after said time period when said recorded medium leaves said transfer position.

6. The image forming apparatus according to claim 5, wherein said execution time interval in said short interval mode is shorter than a stabilizing time, said stabilizing time including a time from said modification of said set value operated by said modification element to when it comes to a stable period, said stable period including a period when fluctuation of said control object value is within a predetermined range, and said execution time interval in said long interval mode is longer than said stabilizing time.

7. The image forming apparatus according to claim 6, wherein said switch element is configured to switch to said short interval mode in a time period when fluctuation of said control object value is outside of said predetermined range, and said switch element is configured to switch to said long interval mode after said time period when said fluctuation is outside of said predetermined range.

8. The image forming apparatus according to claim 5, wherein said switch element is configured to switch to said short interval mode in a time period when fluctuation of said control object value is outside of said predetermined range, and said switch element is configured to switch to said long interval mode after said time period when said fluctuation is outside of said predetermined range.

9. An image forming apparatus, comprising:

a transfer element;

a supply element configured to supply electricity to said transfer element, said electricity depending on a set value;

a detection element configured to detect a control object value, said control object value including either one of a voltage value and a current value, said control object value being supplied to said transfer element;

a modification element configured to operate a modification of said set value, said modification depending on a difference between said control object value detected by said detection element and a target value; and a switch element configured to switch between a short interval mode and a long interval mode, wherein:

an execution time interval for said modification of said set value by said modification element in said short interval mode is shorter than said execution time interval for said modification of said set value in said long interval mode, and in said short interval mode and in a case where a difference between said control object value and said target value is equal to or less than a predetermined value, a modification unit amount that is a modification amount for said set value per unit amount of said difference is smaller in comparison with a case where said difference is larger than said predetermined value.

10. Said image forming apparatus according to claim 9, wherein, in said case where said difference between said control object value and said target value is equal to or less than said predetermined value, said modification unit amount is smaller in said short interval mode than in said long interval mode.

11. Said image forming apparatus according to claim 9, wherein, in said case where said difference between said control object value and said target value is larger than said predetermined value, said modification unit amount is larger in said short interval mode than in said long interval mode.

12. Said image forming apparatus according to claim 9, wherein, in said short interval mode and in said case where said difference between said control object value and said target value is larger than said predetermined value, said modification amount based on said modification unit amount of said short interval mode is added to or subtracted from a base set value based on said modification unit amount of said long interval mode, thereby obtaining said set value.

13. The image forming apparatus according to claim 9, wherein said execution time interval in said short interval mode is shorter than a stabilizing time, said stabilizing time including a time from said modification of said set value operated by said modification element to when it comes to a stable period, said stable period including a period when fluctuation of said control object value is within a predetermined range, and said execution time interval in said long interval mode is longer than said stabilizing time.

14. The image forming apparatus according to claim 13, wherein said switch element is configured to switch to said short interval mode in a time period when fluctuation of said control object value is outside of said predetermined range, and said switch element is configured to switch to said long interval mode after said time period when said fluctuation is outside of said predetermined range.

15. The image forming apparatus according to claim 9, wherein said switch element is configured to switch to said short interval mode in a time period when fluctuation of said control object value is outside of said predetermined range, and said switch element is configured to switch to said long interval mode after said time period when said fluctuation is outside of said predetermined range.

16. An image forming apparatus, comprising:

a transfer element;

a supply element configured to supply electricity to said transfer element, said electricity depending on a set value;

a detection element configured to detect a control object value, said control object value including either one of a voltage value and a current value, said control object value being supplied to said transfer element;

a modification element configured to operate a modification of said set value, said modification depending on a difference between said control object value detected by said detection element and a target value; and a switch element configured to switch between a short interval mode and a long interval mode; and a measurement element and a correction element, wherein said measurement element is configured to measure impedance in a power supply path of said transfer element, and wherein said correction element is configured to correct a modification unit amount that is a modification amount for said set value per a unit amount of a difference between said control object value and said target value based on a value measured by said measurement element, and wherein an execution time interval for said modification of said set value by said modification element in said short interval mode is shorter than said execution time interval for said modification of said set value in said long interval mode.

17. Said image forming apparatus according to claim 16, further comprising a memory element configured to memorize a plurality of sets of data of correspondence relation between said impedance and said modification unit amount, wherein said correction element corrects said modification amount per a unit time for said set value based on said value measured by said measurement element and said data of correspondence relation.

18. The image forming apparatus according to claim 16, wherein said execution time interval in said short interval mode is shorter than a stabilizing time, said stabilizing time including a time from said modification of said set value operated by said modification element to when it comes to a stable period, said stable period including a period when fluctuation of said control object value is within a predetermined range, and said execution time interval in said long interval mode is longer than said stabilizing time.

19. The image forming apparatus according to claim 18, wherein said switch element is configured to switch to said short interval mode in a time period when fluctuation of said control object value is outside of said predetermined range, and said switch element is configured to switch to said long interval mode after said time period when said fluctuation is outside of said predetermined range.

20. The image forming apparatus according to claim 16, wherein said switch element is configured to switch to said short interval mode in a time period when fluctuation of said control object value is outside of said predetermined range, and said switch element is configured to switch to said long interval mode after said time period when said fluctuation is outside of said predetermined range.

* * * * *